US005232149A

United States Patent [19]

Stoll

[11] Patent Number: 5,232,149

[45] Date of Patent: Aug. 3, 1993

[54] TOTE CONTAINER MADE FROM A BLANK HAVING DIAGONALLY BIASED CORRUGATIONS AND METHOD FOR CONSTRUCTING SAME

[75] Inventor: Mark S. Stoll, Deephaven, Minn.

[73] Assignee: Liberty Diversified Industries, New Hope, Minn.

[21] Appl. No.: 529,761

[22] Filed: Feb. 24, 1989

Related U.S. Application Data

[63] Continuation of Ser. No. 64,514, Jun. 22, 1987, abandoned.

[51] Int. Cl.[5] ..... B65D 25/00

[52] U.S. Cl. ..... 229/105; 229/114; 229/940; 229/930; 493/59; 493/160

[58] Field of Search ..... 229/23 A, 23 AB, 23 R, 229/105, 113, 114, DIG. 5, 917, DIG. 4; 150/49, 51; 264/287; 493/59-62, 160, 161, 354, 355, 395-404

[56] References Cited

U.S. PATENT DOCUMENTS

| | | | |
|---|---|---|---|
| 1,845,456 | 2/1932 | Wagner | 493/62 |
| 1,845,891 | 12/1932 | Schroeder | 493/62 |
| 1,866,230 | 7/1932 | Stubbs | 229/105 |
| 1,982,557 | 11/1934 | Watson | 229/105 |
| 3,039,372 | 6/1962 | Bombard | 493/61 |
| 3,043,068 | 7/1962 | Blonder | 493/59 |
| 3,516,594 | 6/1970 | Stenzel et al. | 229/114 |
| 3,727,826 | 4/1973 | Shepherd | 229/DIG. 5 |
| 3,758,019 | 9/1973 | Struble | 229/DIG. 5 |
| 3,982,690 | 9/1976 | Krizan et al. | 236/17 |
| 4,210,241 | 7/1980 | Morcom | 229/41 B |
| 4,535,929 | 8/1985 | Sherman, III et al. | 229/142 |
| 4,572,425 | 2/1986 | Russell | 229/39 |
| 4,600,142 | 7/1986 | Quaintance | 229/143 |
| 4,601,407 | 7/1986 | Gillard | 220/DIG. 4 |
| 4,682,727 | 7/1987 | Stoll | 229/DIG. 11 |
| 4,709,852 | 12/1987 | Stoll | 229/119 |
| 4,762,270 | 8/1988 | Stoll et al. | 229/23 |
| 4,763,833 | 8/1988 | Stoll | 229/52 |
| 4,787,515 | 11/1988 | Stoll | 206/509 |

FOREIGN PATENT DOCUMENTS

| | | | |
|---|---|---|---|
| 2149850 | 6/1972 | Fed. Rep. of Germany | 229/DIG. 4 |
| 977069 | 12/1964 | United Kingdom | 229/DIG. 4 |

OTHER PUBLICATIONS

The Wiley Encyclopedia of Packaging Technology, John Wiley & Sons pp. 226-228, 150, 151 (1986).

*Primary Examiner*—Gary E. Elkins
*Attorney, Agent, or Firm*—Moore & Hansen

[57] ABSTRACT

A tote container which is cut to form a blank from a single sheet of double-faced corrugated plastic material, the blank being scored to define individual panels, and those panels folded to an upright position to define a receptacle region. The corrugations of the plastic material define a grain, and the blank for the tote container is oriented upon the sheet of corrugated plastic material such that the lines of grain cross the scored fold lines separating the panels at an acute angle thereto, thereby permitting individual lines of grain to extend under the receptacle region of the tote container and traverse the tote container both laterally and longitudinally. This prevents the planar plies of the double-faced corrugated plastic sheet material from being perforated, and the convoluted intermediate ply from being crushed along the length thereof, when the blank is scored. The folds between the panels are straighter and do not roll or buckle away from positions of the predetermined scored fold lines, and the planar plies will not fray along the edges of the blank.

31 Claims, 2 Drawing Sheets

TOTE CONTAINER MADE FROM A BLANK HAVING DIAGONALLY BIASED CORRUGATIONS AND METHOD FOR CONSTRUCTING SAME

This is a continuation of co-pending application Ser. No. 07/064,514 filed on Jun. 22, 1987 abandoned.

BACKGROUND OF THE INVENTION

This invention relates generally to tote containers which are constructed from a blank of sheet material and the blanks used to form those tote containers, and particularly to a corrugated plastic tote container blank having a diagonally biased grain.

Tote containers which may be cut, scored, and folded to form an upright receptacle from a blank of corrugated paperboard, fiberboard, or plastic are well known to the art. The configurations of those containers, and the respective blanks, range from simple rectangular sheets to complex geometric structures.

Current improvements in tote containers generally relate to a distinct function or use for the tote container, or a particular modification which makes the tote container uniquely superior or more suitable for a particular purpose. These improvements and modifications may relate to any number of features of the tote container, such as the size, shape and manner of interconnecting the panels, the lid, locking structures, stacking capabilities, materials, capacity, durability, and so forth.

Of particular concern to this invention are those tote containers fashioned from a blank which is cut and scored from a three-ply corrugated plastic sheet material. This corrugated plastic sheet material has two planar plies spaced a short distance apart, and a corrugated intermediate ply or series of beams connecting those planar plies. The manufacturing methods for a corrugated plastic sheet material of this type are discussed in U.S. Pat. Nos. 4,267,223; 4,188,253; and 4,132,581.

In general, the plies are extruded and processed through a corrugating machine which bonds them together into a linear corrugated sheet structure which may be rolled or cut into sections. The corrugated sheet has a grain defined by the convolutions of the intermediate corrugated ply.

The corrugated plastic sheet material is then processed in roll or section form to produce the blanks. The sheet material is transported through various feed rollers and dyes which are used to cut out the overall shape of the blank; and scoring rollers are used to impress a pattern of score lines into the surface of the blanks corresponding to the position of the fold lines and panel edges. The waste material outside the perimeter of the blank, and that resulting from material which is removed to form handgrips, ventilation holes, and the like, is discarded or recycled. The blanks may be divided into separate units at this time, or remain as a series of interconnected sections.

The overall external shape of the blank traditionally conforms to a generally square or rectangular form which aids in conserving material, although many alternative shapes such as arcuate or octagonal are known. Examples of square and rectangular blanks are disclosed in U.S. Pat. Nos. 4,600,142 and 4,572,425. An arcuate configuration is shown in U.S. Pat. No. 3,982,690. The exact definitions that the shape of a blank may take, and the general overall shapes of blanks, are effectively limitless.

In positioning the outline of the blank and orienting the score lines on the sheet of corrugated material, the grain is ordinarily aligned so as to extend either parallel with or perpendicular to the edges of the bottom panel or side panels, such that the corrugations lie either parallel or perpendicular to the major or minor axis of the tote container. In this manner, the corrugations will often traverse the bottom panel and extend upwardly along at least two of the side panels to provide for continuous vertical and underlying support.

It is thus incumbent upon the designers of tote containers, and particularly those manufactured from corrugated plastic sheet material, to attempt to incorporate certain universal and well recognized advantages into these tote containers.

One such common advantage is to reduce the amount of material consumed in fabricating the blank, either the material that is used to construct a tote container with a receptacle having a predetermined volume and shape, or the amount of material that is discarded or recycled after the blank is formed.

Another common advantage is to increase the overall strength, durability, and load bearing capacity for a particular design of tote container, through better materials, bonding or fastening means, or placement and orientation of the panels, joints, seams, folds, closures, and other structural features. Another method for achieving this advantage has been to place handgrip openings along the end panels of the tote container, which are then connected by a rim member, with the primary weight supporting side panels being attached to the central portion of the rim member such that the parallel grain of the corrugations extends under the receptacle to form a support along the longitudinal length of the container.

A related advantage is to increase the ease of scoring and folding the tote container, thereby making the tote container simpler and less expensive to assemble, and in turn increasing the strength and structural integrity of the joints, folds, and seams.

Another desired advantage is to increase the number of vertical panels, or the interconnections between those panels, so as to distribute the weight of the load placed in the receptacle over the largest area of vertical support possible.

In attempting to achieve these advantages, however, numerous problems unique to the corrugated plastic sheet material, and therefore not occurring to the same degree in tote containers constructed of paperboard or fiberboard, must be confronted. Far greater pressure is required to score a three-ply corrugated plastic than fiberboard or paperboard, and the scoring rollers and dyes must be carefully aligned along the corrugations. The dimensional tolerances and position of the tote container blank must be strictly controlled in order to prevent perforations of the planar plies and crushing of the intermediate ply, and the dimensional specifications of the tote container then become dependent upon the given corrugated plastic material rather than being dictated by the optimum design configuration for the particular function and construction of that tote container.

Poorly aligned and positioned cut or score lines will also cause splitting and fraying of the free end edges of the tote container. If the tote container is of a type which is repeatedly folded and unfolded, or has some particular mechanical movement of the panels, lid, or closure associated with using the container, these and other similar defects can prevent the tote container from functioning properly or conveniently. The blank must therefore be processed through the cutting and scoring rollers or dyes with great precision.

It is a related advantage to obtain crisp and uniformly scored creases, seams, and folds, which will not roll or shift due to the grain of the corrugated plastic, and to accordingly eliminate the dependency between the dimensional specifications and tolerances of the tote container and the placement of the grain of the corrugated plastic.

BRIEF SUMMARY OF THE INVENTION

It is therefore one object of this invention to design a tote container folded from corrugated plastic sheet material, and a method for orienting the blank from which that tote container is assembled, such that significantly less corrugated plastic sheet material is consumed in fabricating that blank. In the example discussed below, the overall dimensions of the material used to form a generally cross shaped blank may be reduced by over twenty percent.

It is a related object of this invention to design the above tote container and blank such that the assembled tote container may define a receptacle possessing the same volume as tote containers having a similar structural design and manufactured using standard methods.

It is yet another object of this invention to design the above tote container such that the blank may be oriented on the sheet of corrugated plastic for scoring the fold lines without having to align the seams and folds, or adjust the tolerances of the tote container dimensions, to account for the placement of the intermediate corrugated ply and the intermittent gaps which create the grain of the corrugated plastic.

It is a related object of this invention to design the above tote container and blank such that deeper and more uniform fold lines may be scored throughout the entirety of the tote container blank, without the corresponding drawback of perforating the planar plies of the corrugated plastic.

It is an additional object of this invention to design the above tote container and blank such that the fold lines will not buck, pucker, or become rounded due to the placement or misalignment of the corrugated intermediate ply.

It is a further object of this invention to design the above tote container and blank such that the tote container, when folded to its upright position defining a receptacle region, has increased strength and load bearing characteristics due to the orientation of the blank.

It is a related object of this invention to design the above tote container and blank such that the tote container distributes the load placed within the receptacle more evenly around all of the vertical panels, including the side panels, end panels, and end foldover panels, and to increase the total area of the weight bearing panels.

It is another related object of this invention to design the above tote container and blank such that the weight of a load placed within the receptacle, and the vertical support for that weight, is distributed from the handgrip section in the end panels to the adjacent side panels through not only a retaining rim but through the direct interaction of the side, end, and end foldover panels.

It is yet another object of this invention to design the above tote container and blank such that individual lines of grain may be positioned to extend between selected diagonally opposing panels, such as from an end foldover panel across the bottom panel to an adjacent end wall panel, or from an end foldover panel across the bottom panel and the opposing side wall panel to the diagonally opposing end foldover panel.

It is a related object of this invention to design the above tote container thus having individual lines of corrugated plastic grain extending entirely under the load or receptacle region from each of the opposing side panels, or similarly extending under the load from one end of the receptacle to the other, thus traversing both the lateral and longitudinal dimension of the tote container.

It is similarly an object of this invention to design the above tote container such that, as individual panels are overlaid in parallel and abutting contact, a crisscrossed array or lattice is formed by the lines of grain in the overlapping panels.

It is further a related object of this invention that when those overlapping panels are fastened together as by a line of sonic welds placed parallel to the fold lines of the tote container, those welds will each fall along and contact a distinct and separate set of corrugations than those contacted by the adjacent welds.

It is an additional object of this invention to design the above tote container and blank so as to decrease the necessary precision required in processing the corrugated plastic sheet material through the cutting dyes and scoring rollers when forming the blank.

Briefly described, the tote container is constructed from a sheet of three-ply corrugated plastic material which is cut to form a blank, and scored and folded to a generally upright configuration defining a receptacle region. The tote container may be formed from any blank configuration, but has proven most effective for tote containers having a generally cross shaped blank. Such a blank might include a bottom panel, a pair of opposing side wall and end wall panels extending from the bottom panel, and a pair of end foldover panels extending from each of either the end wall or side wall panels. The tote container may also include such optional features as lid panels or flaps, stacking shoulders, a retaining rim, handgrip cutouts, and the like.

The tote container is formed by orienting the dye used to cut the blank on the sheet of corrugated plastic such that the grain of the corrugated plastic crosses the scored fold lines connecting the bottom panel to the side wall and end wall panels, and the end foldover panels to the side wall or end wall panels, at a predominantly acute angle to those scored fold lines.

By reorienting the blank on the corrugated plastic sheet material to occupy a smaller square area, less of that material is consumed in making the blank. Although the scored fold lines initially appear to ripple or be less true or straight, because they may be scored deeper and at precise intervals, the actual folds are more uniform, and rolling or curving of the folds will not occur. All or a substantial percentage of the score lines may be positioned so that the score lines cross the grain of the corrugated plastic at an acute angle, rather than being parallel to the grain, which negates the necessity of carefully aligning the convolutions in the intermediate ply to prevent crushing the ribs or perforating the planer plies.

Different load distribution characteristics may be achieved based upon the particular angle between the grain of the corrugated plastic and the scored fold lines, and the combinations of panels across which a single line of grain may traverse.

The diagonal bias between the grain of the corrugated plastic and the scored fold lines which divide the panels makes it possible to extend individual lines of the grain around the vertical corners of the tote container, and have lines of grain extend under the load traversing the tote container in both the lateral and longitudinal direction, and provide vertical support along both side and end wall panels, as well as the end foldover panels.

Because of the criss-cross effect provided by the overlapping end wall and end foldover panels of the tote container, when a line of sonic welds placed parallel to the fold lines of the tote container is used to secure or fasten the overlapping panels together, each weld contacts a set of lines of grain distinct and separate from those lines of grain contacted by any of the adjacent sonic welds in that line, thereby increasing the overall strength and durability of the tote container.

DESCRIPTION OF THE PREFERRED EMBODIMENT

Figure 3:
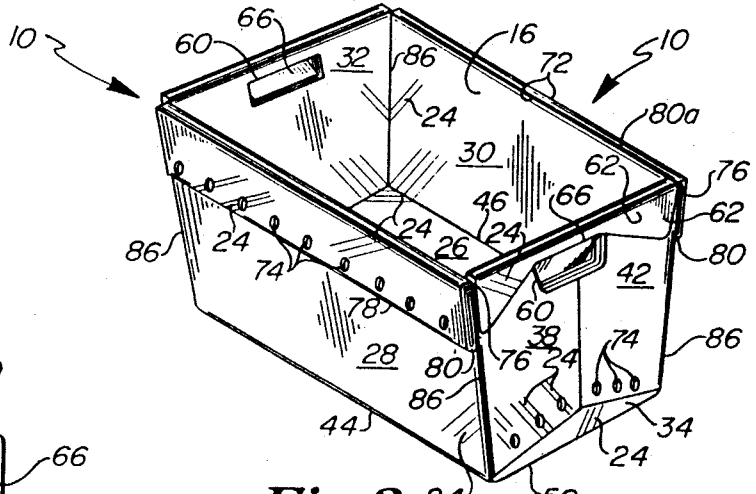
FIG. 3 is a perspective view of the tote container shown in FIG. 1 assembled to its generally upright configuration.

The tote container of this invention, and the blank from which it is formed, are shown in FIGS. 1-6 and referenced generally therein by the numeral 10.

The tote container 10 is comprised of a blank 12 which is cut from a sheet of corrugated plastic 14, and scored and folded to produce the substantially upright tote container 10 defining a receptacle region 16 therein.

While the method of forming the tote container 10 of this invention may be applied to tote container blanks 12 having any variety of shapes and sizes, it has proven most beneficial when applied to the construction of a tote container 10 in which the blank 12 has the overall shape likened to that of a Greek, Teutonic, or Maltese cross including an aureole at the intersection of the crossed members. Such a blank 12 is disclosed in the pending United States patent application bearing Ser. No. 836,059 and has been shown in FIGS. 1, 4, and 5 herein for purposes of illustration.

While the advantages of increased strength, durability, uniform load distribution, and ease of production may be achieved using a blank 12 of almost any shape, the benefit of decreasing the amount of corrugated plastic sheet material 14 consumed and discarded is best obtained with tote containers 10 having blanks 12 of the cross shape as described above.

In those situations wherein the method of forming the tote container 10 of this invention would result in a total increase in the amount of corrugated plastic sheet material 14 consumed, it is necessary to balance the desirability of increased strength, durability, and uniform load distribution with economic considerations such as increased material cost, design and production savings, and end product price in order to determine whether the method would be cost effective in that particular case.

Figure 2:
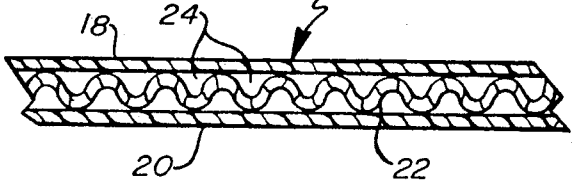
FIG. 2 is a cross sectional view of the corrugated plastic sheet material from which the tote container of this invention is formed taken through line 2—2 of FIG. 1.

Referring to FIG. 2, it can be seen that the corrugated plastic sheet material 14 is comprised of a pair of planar plies 18, 20 spaced a distance apart, with a corrugated or convoluted intermediate ply 22 traversing between the two planar plies 18, 20 and bonded thereto. The two planar plies 18, 20 and the intermediate ply 22 form a series of longitudinally extending channels 24 which together define a grain 24 to the corrugated plastic sheet material 14, as may be seen in FIG. 1.

Figure 1:
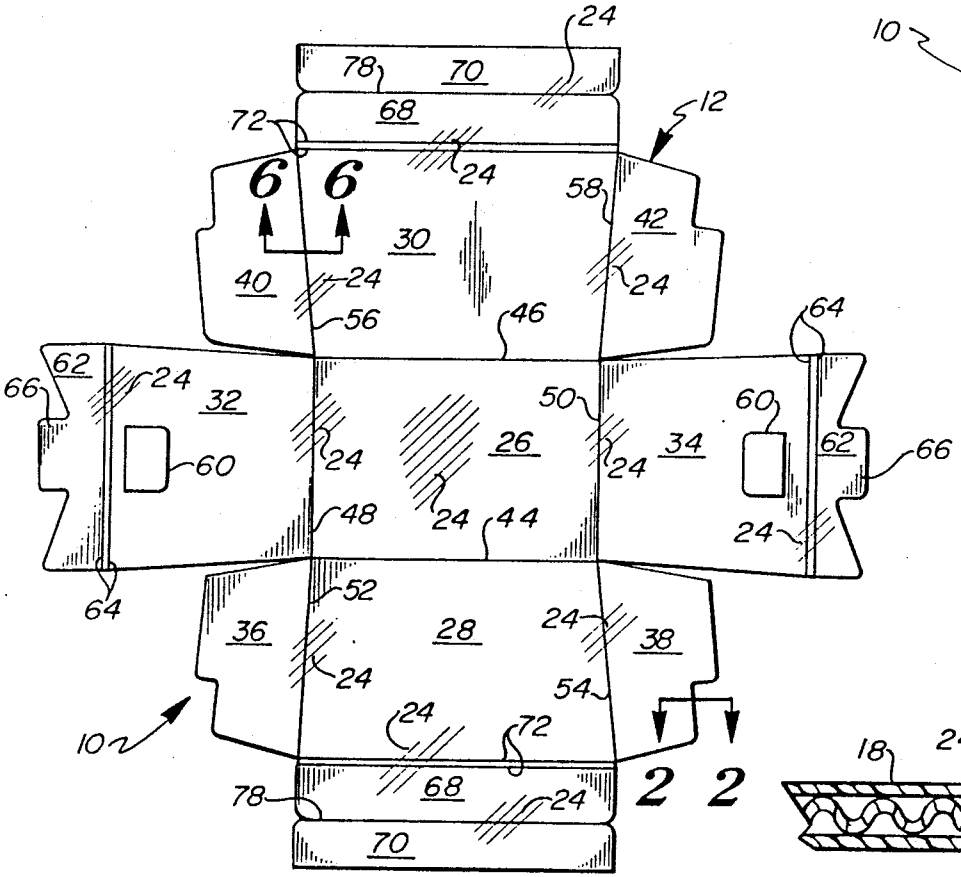
FIG. 1 is a plan view of the cut and scored blank used to form the tote container of this invention.

Referring to FIG. 1, the blank 12 of the tote container is shown to be divided into a bottom panel 26, a pair of opposing side wall panels 28, 30, a pair of opposing end wall panels 32, 34, and two pair of opposing end foldover panels 36, 38, 40, 42.

The side wall panels 28, 30 extend from and are hingedly connected to the bottom panel 26 across scored fold lines 44, 46 corresponding to the side edges of the bottom panel 26, while the end wall panels 32, 34 extend from and are hingedly connected to the bottom panel 26 across scored fold lines 48, 50 which correspond to the end edges of the bottom panel 26. Each pair of end foldover panels 36, 38, 40, and 42 extend from and are hingedly connected to one of the side wall panels 28, 30 across scored fold lines 52, 54, 56, 58 corresponding to the end edges of the side wall panels 28, 30.

Each end wall panel 32, 34 defines a handgrip cutout 60 extending through the surface thereof, and includes an end wall flap 62 which extends from and is hingedly connected to the end wall panel across double scored fold lines 64 corresponding to the top edge of the end wall panels 32, 34 and tote container 10. Each end wall flap 62 also has an outer edge which defines a handgrip reinforcing segment 66.

Each side wall panel 28, 30 includes a pair of side flaps 68, 70 which extend from and are hingedly connected to the side wall panels 28, 30 across double scored fold lines 72 corresponding to the top edge of the side wall panels 28, 30 and tote container 10.

Figure 5:
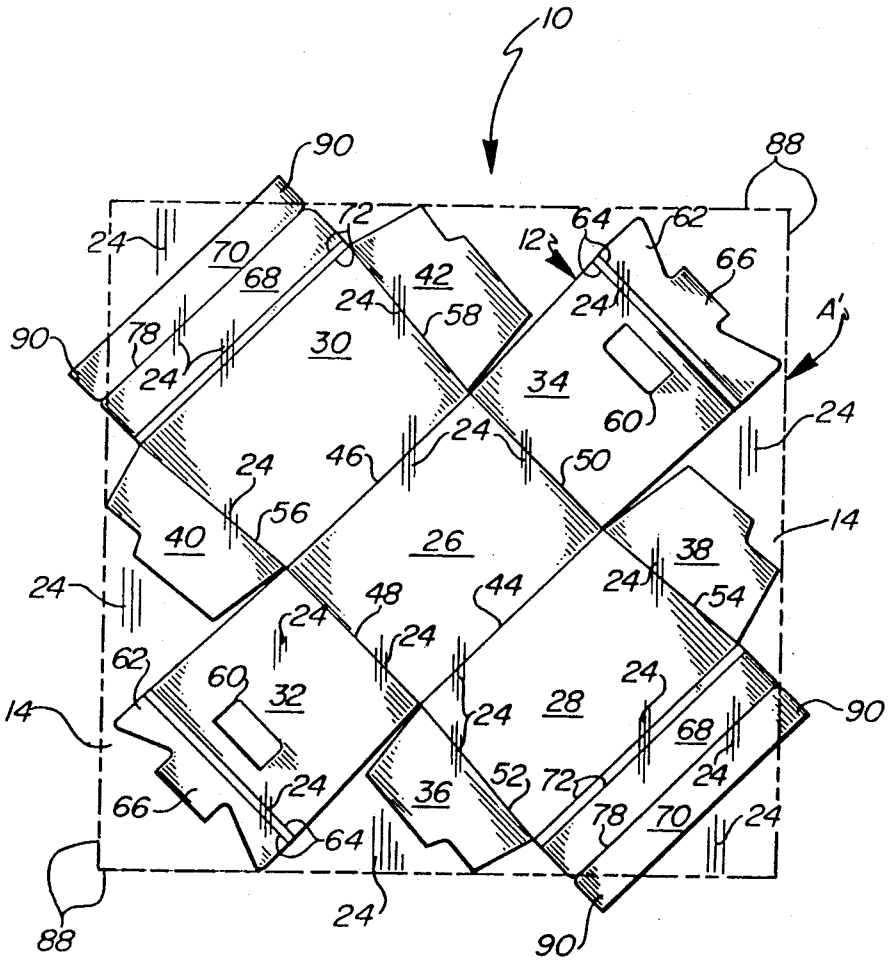
FIG. 5 is a plan view of the cut and scored blank of FIG. 1 positioned and oriented such that the scored fold lines form predominantly acute angles with the grain of the corrugated plastic material.
Figure 4:
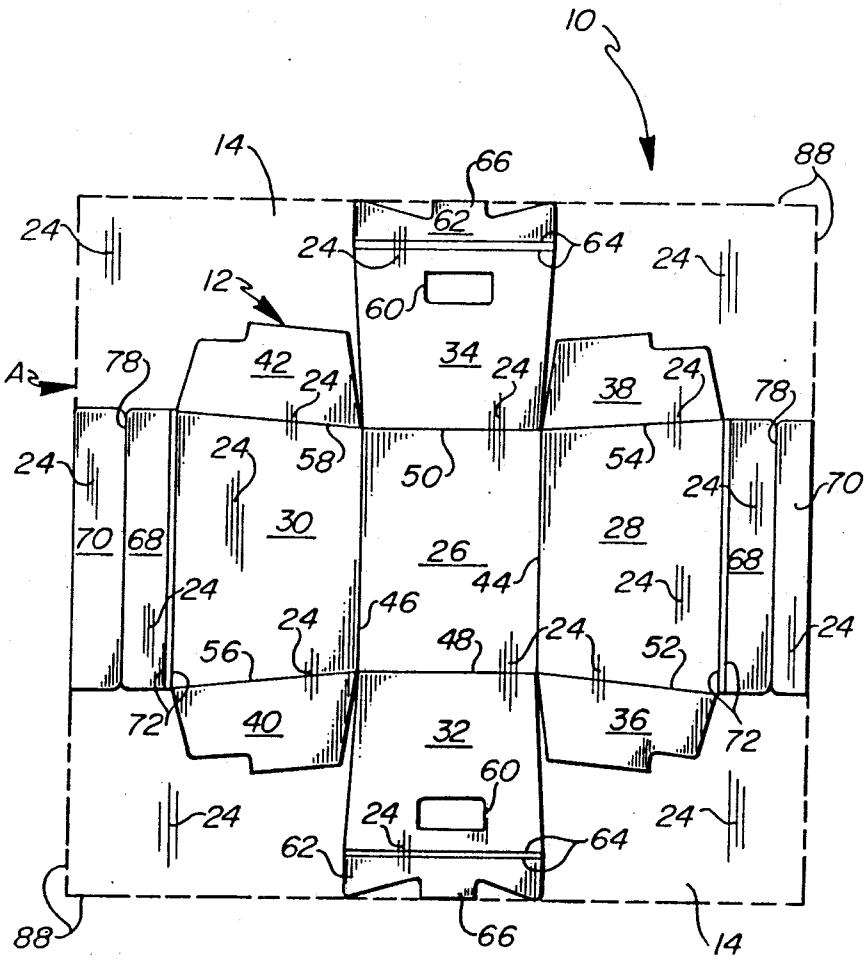
FIG. 4 is a plan view of the cut and scored blank of FIG. 1 positioned and oriented such that the scored fold lines are generally parallel or perpendicular to the grain of the corrugated plastic material.

Consequently, as may be seen in FIGS. 1, 4, and 5, the blank 12 takes on the overall shape of a cross, particularly with respect to the bottom panel 26, side wall panels 28, 30, and end wall panels 32, 34. The definition of this cross is increased when the additional end wall flaps 62 and side flaps 68, 70 are considered, although that definition is conversely diminished slightly when the end foldover panels 36, 38, 40, 42 are included.

Referring to FIG. 3, it may be seen that the blank 12 shown in FIG. 1 may be folded into a generally upright position to define the receptacle 16. In order to assemble the tote container 10 to the upright position, the side wall panels 28, 30 and end wall panels 32, 34 are folded upwardly across the respective scored fold lines 44, 46, 48, 50 and the end foldover panels 36, 38, 40, 42 are similarly folded inwardly across the respective scored fold lines 52, 54, 56, 58 and into close confronting and abutting contact with the end wall panels 32, 34. The end foldover panels 36, 38, 40, 42 are then fastened to the end wall panels 32, 34 using sonic welds 74 or other suitable fasteners.

The tote container 10 may then be placed within a metal retaining rim 76, and the side wall flaps 68, 70 folded once in half across the scored fold lines 78 and then over the metal retaining rim 76 across double scored fold lines 72, thus forming stacking shoulders 80 and 80*a*. One or both of the side wall flaps 68, 70 may then be fastened to the side wall panels 28, 30 using sonic welds 74 or other fasteners. Finally, the end wall flaps 62 may be folded downwardly over the metal retaining rim 76 across double scored fold lines 64 and fastened to the end foldover panels 36, 38, 40, 42, with the handgrip reinforcing segment 66 of the end wall flaps 62 being pressed inwardly through the handgrip cutouts 60 and folded upwardly.

Referring again to FIG. 1, it may be seen that the angle of the grain 24 of the corrugated plastic material 14 crosses each of the scored fold lines 44, 46, 48, 50, 52, 54, 56, 58, 64, 72, and 78 at a generally acute angle thereto, rather than being perpendicular or parallel to those scored fold lines.

Figure 6:
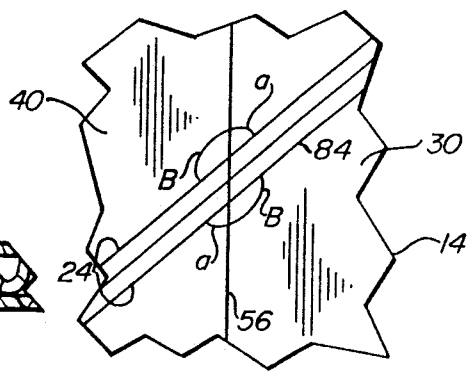
FIG. 6 is a partially broken away view of the angles formed between the scored fold lines and the grain of the corrugated plastic sheet in the tote container blank taken through line 6—6 of FIG. 1.

Referring to FIG. 6, it may be seen from the diagram which depicts a scored fold line 50 and the lines of the grain of the corrugated plastic 24 crossing that scored fold line 50 that for each acute angle a there is a corresponding obtuse angle B having a degree measurement equal to one hundred eight degrees minus the degree measurement of the acute angle a. the term "acute" referring to an angle which is less than 90 degrees and the term "obtuse" referring to an angle greater than 90 degrees. The term "acute" is herein used to describe the relationship of the fold lines and grain as being non-parallel or non-perpendicular. Since for each acute angle a of a particular magnitude between zero and ninety degrees there is an obtuse angle B of inversely proportional magnitude between ninety and one hundred eighty degrees, the term "obtuse" would be equally suitable to define the relationship between lines of the grain 84 and the scored fold line 82.

Consequently, by orienting the blank 12 such that the angle between the grain 24 and scored fold lines 44, 46, 48, 50, 52, 54, 56, 58, 64, 72, 78 is predominantly acute (or obtuse), the grain 24 of the corrugated plastic sheet material 14 crosses the scored fold lines 44, 46, 48, 50, 52, 54, 56, 58, 64, 72, 78 along the interconnection between the bottom panel 26 and the side wall panels 28, 30, the bottom panel 26 and the end wall panels 32, 34, the side wall panels 28, 30 and the end foldover panels 36, 38, 40, 42, the end wall panels 32, 34 and the end wall flaps 62 and the side wall panels 28, 30, and the side wall flaps 68, 70.

Referring to FIG. 3, it can be seen that because the grain 24 crosses the scored fold lines 52, 54, 56, 58 the grain extends around the corners 86 of the upright tote container 10. Similarly, the grain 24 of the overlapping end wall panels 32, 34, end foldover panels 36, 38, 40, 42, and end wall flaps 62 form a criss-crossing lattice, and each adjacent sonic weld 74 contacts a set of lines of grain 24 distinct and separate from those lines of grain 24 contacted by an adjacent sonic weld 74 in at least one of the panels or flaps 32, 34, 36, 38, 40, 42, 62. This division of the sonic welds 74 between lines of grain 24 should occur in any line of adjacent sonic welds 74 which are placed in a line positioned generally parallel to the corners 86 of the tote container 10 or the scored fold lines 48, 50, 52, 54, 56, 58.

Referring to FIG. 1, it can be seen that any single line of the grain 24 may be made to extend from one of the end foldover panels 36 across the adjacent side wall panel 28 or bottom panel 26 to the opposing end foldover panel 38, the opposing end wall panel 34, the opposing side wall panel 30, or the diagonally opposing end foldover panel 42, depending upon the angle a of the grain 24 relative to the score lines 50, 52, 54, 56, 58.

In this manner, a far greater range of load distribution characteristics may be selected and achieved depending upon the angle between the grain 24 of the various score fold lines 44, 46, 48, 50, 52, 54, 56, 58, 64, 72, 78, and the particular combinations of panels 26, 28, 30, 32, 34, 36, 38, 40, 42 and flaps 62, 68, 70 across which single lines of grain 24 traverse.

The rectangular bottom panel 26 defines a lateral dimension for the tote container 10 between the side edges 44, 46, and a longitudinal dimension between the edges 48, 50. The lines of grain 24 may traverse both the lateral and longitudinal dimension of the tote container 10 under the load placed in the receptacle region 16, thereby interconnecting the vertical support provided by each of the side wall panels 28, 30 and end wall panels 32, 34.

In order to conserve the maximum amount of material when dealing with a cross shape blank 12 as shown, the angle a should be approximately 45 degrees, although the measure of load distribution and the relationship between lateral and vertical support will vary depending upon the measure of the angle a and whether the edges and corners 86 of the tote container 10 are squared or themselves angled. As in this case, the receptacle region 16 of the tote container 10 is a tapered and truncated rectangular prism, such that the angles between the bottom 26 and end wall 32, 34 or side wall panels 28, 30, and between the side wall 28, 30 and end wall panels 32, 34 themselves, are not square. This affects the perceived angle of deflection as the grain rounds those corners 86, and similarly alters the proportion of lateral and vertical support between the panels.

Referring now to FIGS. 4 and 5, it may be seen that reorienting the blank 12 on the sheet of corrugated plastic 14 will conserve the amounts of material 14 used in constructing the blank. In FIG. 4, a cross-shaped blank 12 is oriented in a standard manner wherein the lines of grain 24 extend parallel to the scored fold lines 44, 46, 48, 50 of the bottom panel 26 of the tote container 10. In this manner, the blank 12 consumes a section of sheet material bounded by four lines 88 and having a square area of A. The same blank 12, reoriented such that the lines of grain 24 now extend at an acute and approximately forty-five degree angle relative to the scored fold lines 44, 46, 48, 50 of the bottom panel 26 of the tote container 10, as shown in FIG. 5, consumes a section of sheet material bounded by four lines 88 and having a much smaller square area of A'.

Given the blank of FIG. 4 having overall dimensions between lines 88 of $44\frac{1}{8}'' \times 45\frac{5}{8}''$ and consuming that amount of sheet material 14, the size of the section of material 14 used to form the same shape tote container 10 having the same volume receptacle 16, when reoriented as in FIG. 5, is $39\frac{1}{2}'' \times 39\frac{1}{2}''$, thus accounting for an overall decrease in material consumption of approximately 22.5 percent.

In order to achieve this particular reduction in consumed material 14, it should be noted that the corners 90 of the side wall flaps 70 are cut off along a generally diagonal line parallel with the grain 24 of the material 14. Similar, greater, and lesser reductions in the amounts of material 14 consumed may be produced depending upon the shape and size of the blank 12 for the tote container 10, and the angle at which the blank 12 is reoriented.

While the preferred embodiments of the present invention have been described, it should be understood that various changes, adaptations and modifications may be made therein without departing from the spirit of the invention and the scope of the appended claims.

What is claimed is:

1. Blank for a tote container which is cut, scored by a scoring instrument, and folded to a generally upright position from a double-faced corrugated plastic sheet material, said double-faced corrugated plastic sheet material having a pair of planar plies and an intermediate ply, each of said pair of planar plies being generally parallel to one another and spaced apart a distance, said intermediate ply extending between and being connected to each of said planar plies, said intermediate ply having a multiplicity of convolutions formed therein defining a longitudinal grain in said double-faced corrugated plastic sheet material, said scoring instrument contacting a surface of at least a one of said pair of planar plies when said blank is scored, said blank for said tote container comprising:

a bottom panel having opposing side edges and opposing end edges, a pair of side wall panels extending from said hingedly connected to said opposing side edges of said bottom panel along scored fold lines, and a pair of end wall panels extending from and hingedly connected to said opposing end edges of said bottom panel along scored fold lines, such that the longitudinal grain of the corrugated plastic sheet material crosses said scored fold lines connecting the side wall panels and bottom panel and said scored fold lines connecting the end wall panels and bottom panel at a predominantly acute angle relative to said fold lines so that the scoring instrument does not perforate through the surface of the at least one of the pair of planar plies contacted by the scoring instrument along the longitudinal grain of the double-faced corrugated plastic sheet material when the blank is scored, and further such that the scored fold lines are generally not aligned parallel with and overlapping the longitudinal grain of the double-faced corrugated plastic sheet material.

2. The blank for the tote container of claim 1 wherein each of the side wall panels has opposing end edges, said blank for the tote container further comprising:

a pair of end foldover panels extending from each of the side wall panels and hingedly connected to said opposing end edges of the side wall panels along scored fold lines, such that the longitudinal grain of the double-faced corrugated plastic sheet material crosses said scored fold lines connecting said pair of end foldover panels to the side wall panels at a predominantly acute angle relative to said scored fold lines.

3. The blank for the tote container of claim 2 wherein an individual and continuous line of the longitudinal grain of the double-faced corrugated plastic sheet material extends from a one of the pair of end foldover panels across a one of the pair of side wall panels, the bottom panel, and a one of the pair of end wall panels.

4. The blank for the tote container of claim 3 further comprising:

a pair of end wall flaps, each said pair of end wall flaps extending from and hingedly connected to a one of the end wall panels along scored fold lines, and wherein the continuous line of the longitudinal grain extends across at least a one of said pair of end wall flaps.

5. The blank for the tote container of claim 2 wherein an individual and continuous line of the longitudinal grain of the double-faced corrugated plastic sheet material extends from a one of the end foldover panels across a one of the pair of side wall panels, the bottom panel, a one of the pair of side wall panels, and a one of the pair of end foldover panels.

6. The blank for the tote container of claim 2 further comprising:

a pair of said wall flaps, each of said pair of side wall flaps extending from and hingedly connected to a one of the pair of side wall panels, wherein an individual and continuous line of the longitudinal grain of the double-faced corrugated plastic sheet material extends from a one of the pair of end foldover panels across a one of the pair of side wall panels, the bottom panel, a one of the pair of side wall panels, and at least a one of said pair of side wall flaps.

7. The blank for the tote container of claim 2 wherein the side wall panels are folded upwardly across the scored fold lines connecting the pair of side wall panels to the bottom panel, the pair of end wall panels are folded upwardly across the scored fold lines connecting the pair of end wall panels to the bottom panel, and each of the pair of end foldover panels are folded inwardly across the scored fold lines connecting each of the pair of end foldover panels to the pair of side wall panels and into overlapping and abutting contact with the pair of end wall panels to form the generally upright position of the tote container, and further wherein the longitudinal grain of the double-faced corrugated plastic sheet material of each of the pair of end foldover panels crosses the longitudinal grain of the pair of end wall panels at a predominantly acute angle to form a criss-crossed lattice pattern therebetween.

8. The blank for the tote container of claim 7 wherein each of the pair of end foldover panels is secured to the pair of end wall panels by a line of adjacent fasteners, a first one of said line of adjacent fasteners contacting a first set of lines of the longitudinal grain of the corrugated plastic sheet material, a second one of said line of adjacent fasteners contacting a second set of lines of the longitudinal grain of the corrugated plastic sheet material, said first set of lines of the longitudinal grain being separate and distinct from said second set of lines of the longitudinal grain.

9. The blank for the tote container of claim 1 or 2 wherein the predominately acute angle measures between thirty and sixty degrees inclusive.

10. The blank for the tote container of claim 1 or 2 wherein the predominantly acute angle measures approximately forty-five degrees.

11. A method for constructing a generally upright tote container from a double-faced corrugated plastic sheet material having a pair of planar plies and an intermediate ply, each of said pair of planar plies being generally parallel to one another and spaced apart a distance, said intermediate ply extending between and being connected to each of said pair of planar plies, said intermediate ply having a multiplicity of convolutions formed therein defining a longitudinal grain in said double-faced corrugated plastic sheet material said method comprising the steps of:

cutting the double-faced corrugated plastic sheet material to form a blank, said blank being substantially bounded by an outer perimeter, said outer perimeter having four sides forming an approximately rectangular overall shape;

scoring scored fold lines onto said blank with a scoring instrument, said scoring instrument contacting a surface of at least a one of the pair of planar plies when said blank is scored, said scored fold lines dividing said blank into a plurality of panels, said plurality of panels being connected to one another along said scored fold lines, said plurality of panels including a bottom panel, a pair of side wall panels, and a pair of end wall panels, said blank and said scored fold lines being positioned and oriented such that the longitudinal grain of the double-faced corrugated plastic sheet material extends across said blank at a predominantly acute angle relative to said scored fold lines so that said scoring instrument does not perforate through said surface of said at least one of the pair of planar plies contacted by said scoring instrument along the longitudinal grain of the double-faced corrugated plastic sheet material when said blank is scored, and further such that said scored fold lines are generally not aligned parallel with and overlapping the longitudinal grain of the double-faced corrugated plastic sheet material;

folding said pair of side wall panels and said pair of end wall panels of said blank across said second fold lines to a generally upright position; and securing said pair of side wall panels and said pair of end wall panels in said upright position to form the generally upright tote container.

12. The method of claim 11 wherein the predominantly acute angle measures between thirty and sixty degrees inclusive.

13. The method of claim 11 wherein the predominantly acute angle measures approximately forty-five degrees.

14. A method for constructing a generally upright tote container from a double-faced corrugated plastic sheet material having a pair of planar plies and an intermediate ply, each of said pair of planar plies being generally parallel to one another and spaced apart a distance, said intermediate ply extending between and being connected to each of said pair of planar plies, said intermediate ply having a multiplicity of convolutions formed therein defining a longitudinal grain in said double-faced corrugated plastic sheet material, said generally upright tote container being tapered and nestable within a like tote container, said method comprising the steps of:

cutting the double-faced corrugated plastic sheet material to form a blank, said blank being substantially bounded by an outer perimeter, said outer perimeter having four sides forming an approximately rectangular overall shape;

scoring scored fold lines onto said blank with a scoring instrument, said scoring instrument contacting a surface of at least a one of the pair of planar plies when said blank is scored, said scored fold lines dividing said blank into a plurality of panels, said plurality of panels being connected to one another along said scored fold lines, said plurality of panels including a bottom panel, a pair of side wall panels, a pair of end wall panels, and a pair of end foldover panels, said blank and said scored fold lines being positioned and oriented such that the longitudinal grain of the double-faced corrugated plastic sheet material extends across said blank at a predominantly acute angle relative to said scored fold lines so that said scoring instrument does not perforate through said surface of said at leas tone of the pair of planar plies contacted by said scoring instrument along the longitudinal grain of the double-faced corrugated plastic sheet material when said blank is scored, and further such that said scored fold lines are generally not aligned parallel with and overlapping the longitudinal grain of the double-faced corrugated plastic sheet material; and folding said blank across said scored fold lines to form the generally upright tote container, said blank being folded such that the longitudinal grain of the double-faced corrugated plastic sheet material extends across said scored fold lines dividing said bottom panel, said pair of side wall panels, said pair of end wall panels, and said end foldover panels at a predominantly acute angle thereto.

15. The method of claim 14 wherein the predominantly acute angle measures between thirty and sixth degrees inclusive.

16. The method of claim 14 wherein the predominantly acute angle measures approximately forty-five degrees.

17. A method for constructing a generally upright tote container from a double-faced corrugated plastic sheet material having a pair of planar plies and an intermediate ply, each of said pair of planar plies being generally parallel to one another and spaced apart a distance, said intermediate ply extending between and being connected to each of said pair of planar plies, said intermediate ply having a multiplicity of convolutions formed therein defining a longitudinal grain in said double-faced corrugated plastic sheet material, said method comprising the steps of:

cutting the double-faced corrugated plastic sheet material to form a blank in the general shape of a cross;

scoring scored fold lines onto said blank with a scoring instrument, said scoring instrument contacting a surface of at least a one of the pair of planar plies when said blank is scored, said scored fold lines dividing said blank into a plurality of panels, said plurality of panels being connected to one another along said scored fold lines, said plurality of panels including a bottom panel, a pair of side wall panels, and a pair of end wall panels, said blank and said scored fold lines being positioned and oriented such that the longitudinal grain of the double-faced corrugated plastic sheet material extends across said blank at a predominantly acute angle relative to said scored fold lines so that said scoring instrument does not perforate through said surface of said at least one of the pair of planar plies contacted by said scoring instrument along the longitudinal grain of the double-faced corrugated plastic sheet material when said blank is scored, and further such that said scored fold lines are generally not aligned parallel with and overlapping the longitudinal grain of the double-faced corrugated plastic sheet material; and folding said blank across said scored fold lines to form the generally upright tote container, said blank being folded such that the longitudinal grain of the double-faced corrugated plastic sheet material extends across said scored fold lines dividing said bottom panel, said pair of side wall panels, and said pair of end wall panels at a predominantly acute angle thereto.

18. The method of claim 17 wherein the predominantly acute angle measures between thirty and sixty degrees inclusive.

19. The method of claim 17 wherein the predominantly acute angle measures approximately forty-five degrees.

20. A method for constructing a generally upright tote container from a double-faced corrugated plastic sheet material having a pair of planar plies and an intermediate ply, each of said pair of planar plies being generally parallel to one another and spaced apart a distance, said intermediate ply extending between and being connected to each of said pair of planar plies, said intermediate ply having a multiplicity of convolutions formed therein defining a longitudinal grain in said double-faced corrugated plastic sheet material, said method comprising the steps of:

cutting the sheet material to form a blank, said blank being substantially bounded by a perimeter, said perimeter having four corners including two pair of diagonally opposing corners, each said pair of diagonally opposing corners having a length measured therebetween, said length measured along a first line extending between a one of said pair of diagonally opposing corners being approximately equal to said length measured along a second line extending between a remaining one of said pair of diagonally opposing corners, said perimeter thus forming an approximately square overall shape, said blank being oriented such that said first line extends in a direction generally parallel to the longitudinal grain of the corrugated plastic sheet material;

scoring scored fold lines onto said blank with a scoring instrument, said scoring instrument contacting a surface of at least a one of the pair of planar plies when said blank is scored, said scored fold lines dividing said blank into a plurality of panels, said plurality of panels being connected to one another along said scored fold lines, said plurality of panels including a bottom panel, a pair of side wall panels, and a pair of end wall panels, said blank and said scored fold lines being positioned and oriented such that the longitudinal grain of the double-faced corrugated plastic sheet material extends across said blank at a predominantly acute angle relative to said scored fold lines so that said scoring instrument does not perforate through said surface of said at least one of the pair of planar plies contacted by said scoring instrument along the longitudinal grain of the double-faced corrugated plastic sheet material when said blank is scored, and further such that said scored fold lines are generally not aligned parallel with and overlapping the longitudinal grain of the double-faced corrugated plastic sheet material; and folding said blank across said scored fold lines to form the generally upright tote container, said blank being folded such that the longitudinal grain of the double-faced corrugated plastic sheet material extends across said scored fold lines dividing said bottom panel, said pair of side wall panels, and said pair of end wall panels at a predominantly acute angle thereto.

21. The method of claim 20 wherein the predominantly acute angle measures between thirty and sixty degrees inclusive.

22. The method of claim 20 wherein the predominantly acute angle measures approximately forty-five degrees.

23. A tote container folded to a generally upright position from a blank cut from a double-faced corrugated plastic sheet material, said blank being folded across a plurality of scored fold lines, said double-faced corrugated plastic sheet material having a pair of planar plies and an intermediate ply, each of said pair of planar plies being generally parallel to one another and spaced apart a distance, said intermediate ply extending between and being connected to each of said planar plies, said intermediate ply having a multiplicity of convolutions formed therein defining a longitudinal grain, said scored fold lines being made by a scoring instrument, said scoring instrument contacting a surface of at least a one of said pair of planar plies when said blank is scored, said tote container comprising:

a plurality of panels including a first panel and a second panel, wherein said first panel and said second panel are fastened together in overlapping and abutting contact by a line of adjacent sonic welds, said line of adjacent sonic welds being generally parallel to at least one of the scored fold lines of the tote container when the tote container is folded to the generally upright position, a first weld of said line of adjacent sonic welds contacting a first set of lines of the longitudinal grain, said first set of lines of the longitudinal grain being distinct and separate from a second set of lines of the longitudinal grain contacted by a second weld of said line of adjacent sonic welds.

24. In a blank for a tote container formed from a double-faced corrugated plastic material, said double-faced corrugated plastic sheet material having a pair of planar plies and an intermediate ply, each of said pair of planar plies being generally parallel to one another and spaced apart a distance, said intermediate ply extending between and being connected to each of said planar plies, said intermediate ply having a multiplicity of convolutions formed therein defining a longitudinal grain, said blank being cut and scored with a scoring instrument to form a bottom panel, a pair of side wall panels extending from and hingedly connected to said bottom panel along scored fold lines, and a pair of end wall panels extending from and hingedly connected to said bottom panel along scored fold lines, said scoring instrument contacting a surface of at least a one of said pair of planar plies when said blank is scored, said blank being foldable to a generally upright position to form said tote container, the improvement comprising:

orienting the longitudinal grain of the double-faced corrugated plastic sheet material such that the longitudinal grain crosses the scored fold lines connecting the bottom panel and the side wall panels at a predominantly acute angle thereto, and such that the longitudinal grain crosses the second fold lines connecting the bottom panel and the end wall panels at a predominantly acute angle thereto, so that the scoring instrument does not perforate through the surface of the at least one of the pair of planar plies contacted by the scoring instrument along the longitudinal grain of the double-faced corrugated plastic sheet material when the blank is scored, and further such that the scored fold lines are generally not aligned parallel with and overlapping the longitudinal grain of the double-faced corrugated plastic sheet material.

25. The blank of claim 24 wherein the tote container further comprises a pair of end foldover panels extending from and hingedly connected to each of the side wall panels along scored fold lines, and further wherein the longitudinal grain crosses the scored fold lines connecting the end foldover panels and the side wall panels at a predominantly acute angle thereto.

26. The blank of claim 24 wherein the tote container further comprises a pair of end foldover panels extending from and hingedly connected to each of the end wall panels along scored fold lines, and further wherein the longitudinal grain crosses the scored fold lines connecting the end foldover panels and the end wall panels at a predominantly acute angle thereto.

27. A method for constructing a generally upright tote container from a double-faced corrugated plastic sheet material having a pair of planar plies and an intermediate ply, said pair of planar plies each being generally parallel to one another and spaced apart a distance, said intermediate ply extending between and being connected to each of said pair of planar plies, said intermediate ply having a multiplicity of convolutions formed therein defining a longitudinal grain in said double-faced corrugated plastic sheet material, each of said multiplicity of convolutions having a length, said method comprising the steps of:

cutting the double-face corrugated plastic sheet material to form a blank having a perimeter with a generally irregular shape;

scoring scored fold lines onto said blank with a scoring instrument, said scored fold line dividing said blank into a plurality of panels, said plurality of panels being connected to one another along said scored fold lines, said plurality of panels including a bottom panel, a pair of side wall panels, and a pair of end wall panels, said pair of side wall panels and said pair of end wall panels having a plurality of free edges corresponding to and lying along said perimeter of said blank, said blank and said free edges being positioned and oriented such that the longitudinal grain extends substantially across said free edges at a predominantly acute angle relative thereto and said free edges are generally not aligned parallel with and overlapping the longitudinal grain so that the pair of planar plies will not fray adjacent said free edges when said blank is cut along said perimeter, and further so that a plurality of said multiplicity of convolutions closely adjacent to said free edges will not be crushed parallel to and along the length thereof when said blank is cut along said perimeter;

folding said pair of side wall panels and said pair of end wall panels of said blank across said scored fold lines to a generally upright position; and securing said pair of side wall panels and said pair of end wall panels in said upright position to form the generally upright tote container.

28. A blank for a tote container which is cut, scored by a scoring instrument, and folded to a generally upright position from a double-faced corrugated plastic sheet material, said double-faced corrugated plastic sheet material having a pair of planar plies and an intermediate ply, each of said pair of planar plies being generally parallel to one another and spaced apart a distance, said intermediate ply extending between and being connected to each of said planar plies, said intermediate ply having a multiplicity of convolutions formed therein defining a longitudinal grain, each of said multiplicity of convolutions having a length, said blank for said tote container comprising:

a bottom panel having opposing side edges and opposing end edges, a pair of side wall panels extending from and hingedly connected to said opposing side edges of said bottom panel along scored fold lines, and a pair of end wall panels extending from and hingedly connected to said opposing end edges of said bottom panel along scored fold lines, such that the longitudinal grain of the corrugated plastic sheet material crosses said scored fold lines connecting the side wall panels and bottom panel and said scored fold lines connecting the end wall panels and bottom panel at a predominantly acute angle relative to said fold lines so that the scoring instrument does not crush the intermediate ply parallel to the longitudinal grain and along the length of the multiplicity of convolutions closely adjacent to the scored fold lines when the blank is scored.

29. The blank for the tote container of claim 28 wherein each of the side wall panels have opposing and edges, the blank for the tote container comprising:

a pair of end foldover panels extending from each of the side wall panels and hingedly connected to the opposing end edges of the side wall panels along scored fold lines, such that the longitudinal grain of the double-faced corrugated plastic sheet material crosses said scored fold lines connecting each of said pair of end foldover panels to the adjacent side wall panels at a predominantly acute angle relative to said scored fold lines so that the scoring instrument does not crush the intermediate ply parallel to the longitudinal grain and along the length of the multiplicity of convolutions closely adjacent to said scored fold lines connecting each of said pair of end foldover panels to the adjacent side wall panels when the blank is scored.

30. A blank for a tote container which is cut, scored by a scoring instrument, and folded to a generally upright position from a double-faced corrugated plastic sheet material, said double-faced corrugated plastic sheet material having a pair of planar plies and an intermediate ply, each of said pair of planar plies being generally parallel to one another and spaced apart a distance, said intermediate ply extending between and being connected to each of said planar plies, said intermediate ply having a multiplicity of convolutions formed therein defining a longitudinal grain, each of said multiplicity of convolutions having a length, said scoring instrument contacting a surface of at least one of said pair of planar plies along a plurality of predetermined lines when said blank is scored, said blank for said tote container comprising:

a bottom panel having opposing side edges and opposing end edges, a pair of side wall panels extending from and hingedly connected to said opposing side edges of said bottom panel along the scored fold lines, and a pair of end wall panels extending from and hingedly connected to said opposing end edges of said bottom panel along the scored fold lines, such that the longitudinal grain crosses the scored fold lines connecting said side wall panels and said bottom panel at a predominantly acute angle relative to said fold lines, and the longitudinal grain crosses the second fold lines connecting said end wall panels and said bottom panel at a predominantly acute angle relative to said scored fold lines, so that each of said side wall panels and said end wall panels may be folded relative to said bottom panel across a plurality of actual folds substantially along and aligned with a one of the plurality of predetermined lines where the scoring instrument contacts the surface of the one of the pair of planar plies.

31. The blank for the tote container of claim 30 wherein each of the side wall panels has opposing end edges, the blank for the tote container further comprising:

a pair of end foldover panels extending from each of the side wall panels and hingedly connected to the opposing end edges of the side wall panels along scored fold lines, the scoring instrument contacting the surface of at least the one of the pair of planar plies along a second plurality of predetermined lines when the blank is scored to form said scored fold lines connecting each of said pair of end foldover panels to the adjacent side wall panels, such that the longitudinal grain of the double-faced corrugated plastic sheet material crosses said scored fold lines connecting each of said pair of end foldover panels to the adjacent side wall panels at a predominantly acute angle relative to said scored fold lines so that each of said pair of end foldover panels may be folded relative to the adjacent side wall panels across a second plurality of actual folds substantially along and aligned with said second plurality of predetermined lines where the scoring instrument contacts the surface of the one of the pair of planar plies.

* * * * *